United States Patent [19]

Boyar

[11] Patent Number: 4,910,901

[45] Date of Patent: Mar. 27, 1990

[54] SIGN POST ASSEMBLY

[76] Inventor: Florene E. Boyar, 7150 Old Temescal Rd., Corona, Calif. 91719

[21] Appl. No.: 245,698

[22] Filed: Sep. 19, 1988

[51] Int. Cl.[4] ..... G09F 15/00

[52] U.S. Cl. ..... 40/607; 40/606

[58] Field of Search ..... 40/606, 607, 617; 248/545, 156

[56] References Cited

U.S. PATENT DOCUMENTS

| | | | |
|---|---|---|---|
| 2,409,076 | 10/1946 | Steinberger et al. | 40/607 |
| 4,103,445 | 8/1978 | Smith et al. | 40/607 |
| 4,249,715 | 2/1981 | Repp | 40/607 |
| 4,326,352 | 4/1982 | Barth | 40/607 |
| 4,327,514 | 5/1982 | Bourque | 40/607 |
| 4,378,650 | 4/1983 | Ottoson | 40/607 |
| 4,524,533 | 6/1985 | Still, Jr. | 40/606 |
| 4,667,829 | 5/1987 | Edmund - White | 40/607 |

*Primary Examiner*—Gene Mancene
*Assistant Examiner*—Michael Lynch
*Attorney, Agent, or Firm*—Harvey S. Hertz

[57] ABSTRACT

Apparatus for holding a sign a distance above the ground includes a first hollow member having a ground penetrating end, an upper end, and a length. A second hollow member is reciprocally removably attached to and parallel to the length of the first member. Impact is provided from reciprocating movement of the second member on the first member. The second member is fixed to the first member at a selectable position along the length of the first member. The second member has an enclosed sleeve attached to the upper end thereof. A third member is removably, perpendicularly attached to an upper portion of the second member and slidably movable through the enclosed sleeve. At least one sign is secured to the third member by a tab having a downwardly extending flange for receiving a sign-hanging hook. A pair of upwardly extending flanges define a groove into which an upwardly extending sign may be placed. The tab has an aperture portion for receiving the third member therein. The tab is fixedly secured to the third member at a predetermined position.

2 Claims, 1 Drawing Sheet

SIGN POST ASSEMBLY

BACKGROUND OF THE INVENTION

1. Field of Invention

The present invention relates to sign post assemblies, and, more particularly, to portable, temporary signs such as are used to advertise real estate.

2. Prior Art

Signs such as are used in the real estate industry come in wide variety of shapes and sizes. They are tranported in the vehicle of the individual real estate agent and erected by the agent for a day, such as in the case of an open house, or for several months, such as in the case of a "For Sale" sign placed in front of a property to be sold. In any event, such signs must be sturdy, as they are re-used; they must be firmly fixed in place; and they must be removable. They must be put up and taken down in all kinds of soil and in all kinds of weather, usually by individuals who are physically and mechanically ill-equipped to do so. A common form of outdoor real estate sign comprises a 2"×2" wooden post which is sharpened on one end and simply driven into the ground. Near the top of the post, a hole is drilled to receive a bolt which is used to secure a cross member. The cross member is simply a laminate of wooden boards with a notch in the approximate vicinity of one end. The notch receives the upright post; the cross member laminate may also be provided with an upper groove to receive a small upper sign placed above the cross member, from which the main sign is hung.

Ottoson U.S. Pat. No. 4,378,650 discloses a sign post comprising a base adapted to be driven into the ground by means of a driving pipe. The sign post comprises a horizontal member connected to the vertical member.

Repp U.S. Pat. No. 4,249,715 similarly discloses a sign apparatus wherein a post member has attached thereto a horizontal cross member. The post member drives against a plate and shaft when the sign is to be erected.

SUMMARY OF THE INVENTION

The present invention provides a sign suitable for assembly and installation at an outdoor location. After the sign post assembly is no longer needed at one location, it can be removed from the ground, dismantled, and easily transported. It can be easily assembled and erected by one person. It can be used to support a variety of conventional signs, or special signs may be designed to fit with the assembly. The present invention further provides an assembly which can firmly be driven into the ground without tools and provides means for adjusting the height of the sign(s) to be mounted without the use of tools. The foregoing and other advantages are provided by a sign post assembly which comprises a stake member, a drive post, and a crossbar. The stake member comprises a sharpened end for entering the ground and an impact portion projecting laterally therefrom. The drive post slides over the stake member for a substantial portion of their respective lengths, providing a guide means for directing upward and downward movement of the drive post over the stake member. The drive post impacts the stake member to drive the latter into the ground. The drive post is also adjustable relative to the stake member, providing adjustable height to signs demountably affixed to the crossbar. The crossbar simply mounts to an upper portion of the drive post. A number of tabs are provided for adjustable and removable attachment to the crossbar, providing means for supporting a variety of types of signs on the sign holder assembly.

DESCRIPTION OF THE PREFERRED EMBODIMENT

Figure 1:
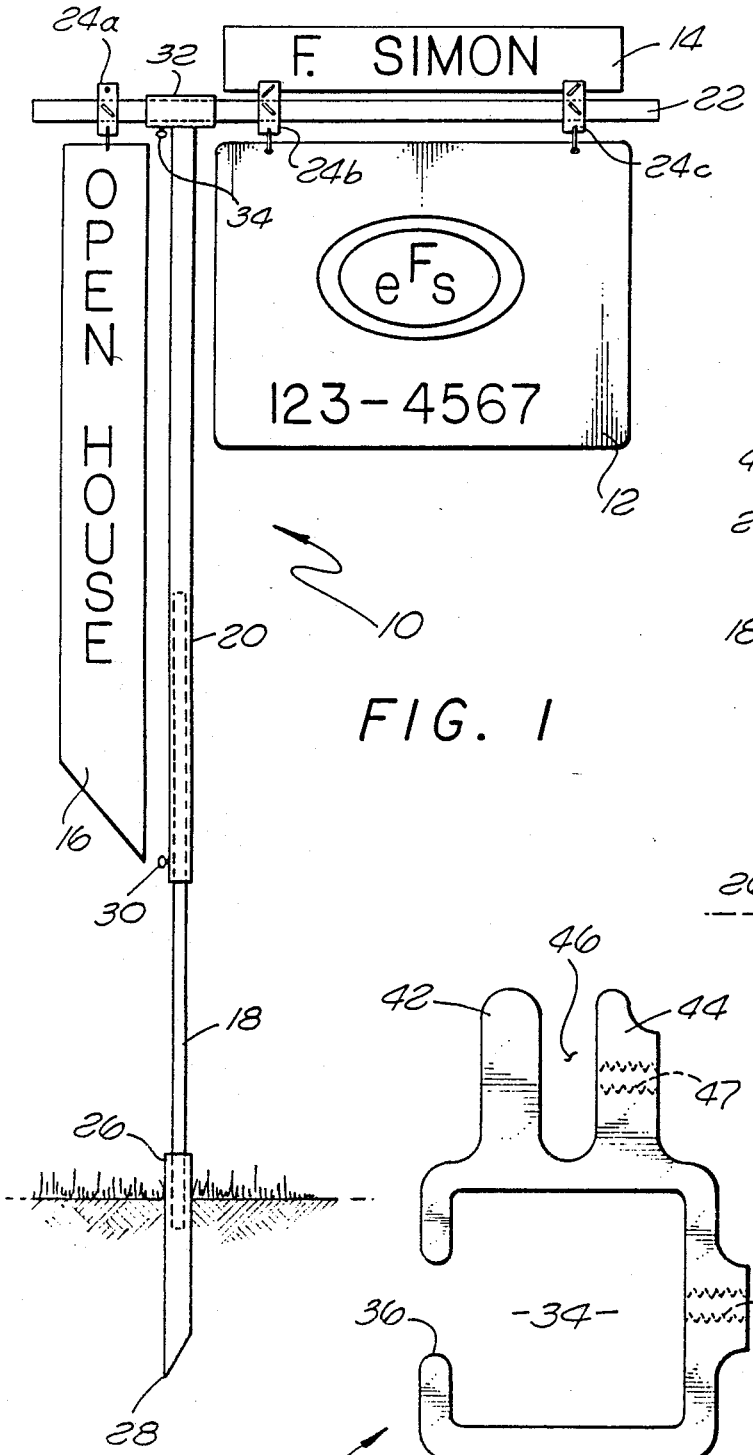
FIG. 1 is a front view of the sign post assembly of the present invention in use as fully assembled and erected.

Referring now to FIG. 1, the sign post assembly 10 of the present invention is shown in use in the gorund, with signs 12, 14, 16 attached. From the following description, it will be apparent that these signs and the various elements of the present assembly can easily be disassembled for compact storage, particularly, since the elements of greatest size are essentially square tubes, viz. stake member 18, drive post 20, and cross member 22. As illustrated, stake member 18 comprises a lower portion, fixed in the ground, and an upper portion which is received into the drive post 20 along both members longitudinal axis. The crossbar 22 slides into position through the upper portion of the drive post 20. The crossbar supports a sign 12 on one side of the drive post 20 and another sign 16 on the other side of the drive post. A third sign 14 is positioned above sign 12. All signs 12–16 are secured via identical tabs 24*a*, *b*, *c* described in connection with FIG. 2.

Figure 4:
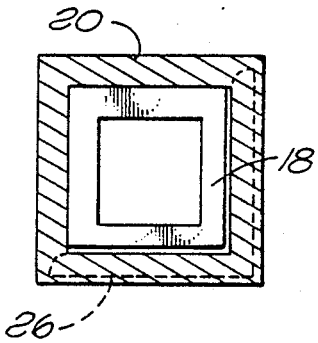
FIG. 4 is a cross sectional end view taken along line 4—4 in FIG. 3.

The stake member 18 comprises aluminum tubing in square cross section approximately 0.75×0.75 inches in outer size. The tubing is about 36 inches long, for a length to width ratio of 48. At the lower portion (i.e., that portion nearest to the ground when the assembly is erected), a steel angle iron 26 is welded to the tubing. The angle iron is 13 inches long and "L" shaped in cross section, and each arm of the L is approximatley one inch long and is fixed to a side of the tubing so that an outer portion of the angle iron extends perpendicularly laterally outwarldy form the length of the tubing, as more fully described in connection with FIG. 4. The angle iron 26 terminates downwardly in a pointed portion 28 defining a sharp end for driving the stake member 18 into the ground via the drive post 20. It has a length to width ratio of 13:1. The corner of the "L" contacts a corner of the stake member 18, as shown in FIG. 4, and the ends of the "L" extend beyond the stake member.

The drive post 20 comprises a square aluminum tube approximately one inch per side in internal width and is of the same approximate thickness as other parts described herein, namely about 0.05 inches thick. A close sliding fit with stake member 18 is provided. The drive post 20 is approximatley 44 inches long and receives into a substantial portion of its lower internal area the stake member 18. The drive post 20 is fitted with an aperture through which is threaded a standard thumb screw 30. By tightening thumb screw 30 against the essentially contiguous outer surface of stake member 18, the height of the signs can be selected to vary over a wide range, essentialy from the length of the stake member to almost the length of the stake member plus the length of the drive post. A sleeve 32 is welded to the top of the drive post 20. The sleeve is an aluminum tube approximately 3 inches long and 1.25×1.25 in internal size, as it is sized to slidably receive the crossbar 22. The maximum width of this piece is therefore 3 inches for a length to width ratio of 14:6. The sleeve 32 comprises a threaded aperture to receive thumb screw 34 which is used to secure the crossbar in its desired position as shown in FIG. 1.

Figure 2:
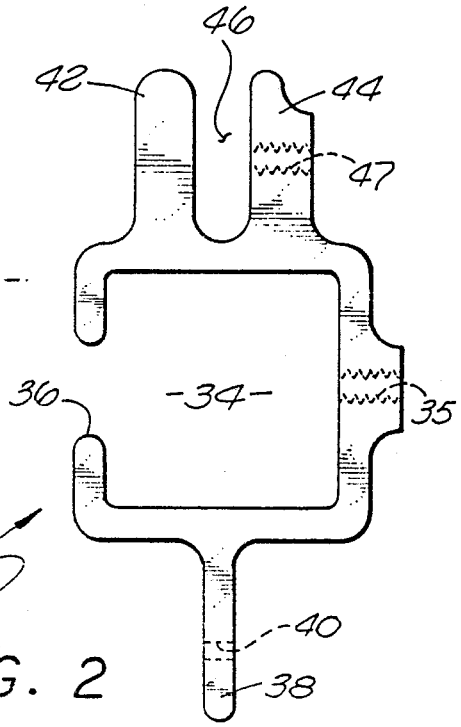
FIG. 2 is an end view of a tab as comprised in the present invention.

The length to width ratio allows compact packing of the present sign into a long cylindrical or rectangular box. The minimum length to width ratio should be 7, i.e., with about a 6 inch sleeve mounted on a 44 inch drive post. Referring now to Figure 2, an end view of a tab 24 illustrates various portions used to secure signs 12–16 to the sign post assembly. A large central aperture 34 receives crossbar 22. A threaded opening 35 receives a standard thumb screw for securing the tab 24 to the crossbar 22. A projection 38 depends downwardly from the tab 24 and contains an aperture 40 through which may be placed standard hooks commonly used to suspend real estate and other signs. A pair of oppositely disposed upper projections 42, 44 define between them a groove 46 which extends in length parallel to the crossbar 22. A threaded hole 47 in projection 44 permits insertion of a thumb screw to secure a sign placed in groove 46. As can be seen in FIG. 1, two grooves 46 serve to define an upright support into which a sign such as shown at 14 can be removably placed. A long, thin sign, such as shown at 16, can also be hung from a single aperture 40. It is contemplated that signs 12–16 will be metal sheets. As shown at 36, FIG. 2, tab 24 is extruded and therefore is open on one side.

Figure 3:
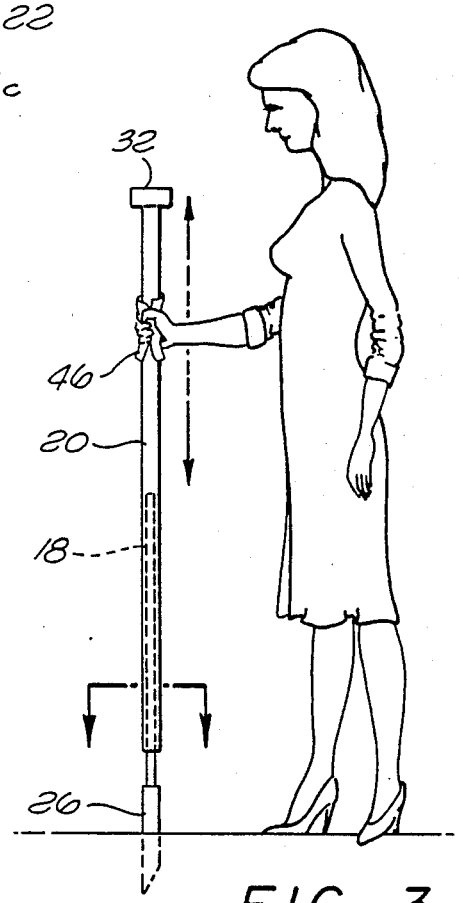
FIG. 3 is a front view of the stake member and drive post of the present invention being driven into the ground.

Referring now to FIG. 3, an individual is shown in a key operation in erecting the sign post assembly of the present invention. The stake member 18 is reciprocally slidably received within drive post 20. The angle iron 26 is being driven into the ground by the impact of the drive member against the angle iron, as shown in FIG. 4. A hand grip 46 is provided to facilitate the stake driving operation. The hand grip 46 is simply a cylindrical piece of pipe insulation, rubber, or the like. Once the driving operation is completed, the crossbar 22 is inserted into the sleeve 32 and secured. Tabs, thumb screws and hooks are used to hang the signs as shown in FIG. 1.

Referring to FIG. 4, the drive post 20 can be seen to impact angle iron 26 which is affixed to the stake member 18 such that the outer portions of the angle iron extend beyond the stake member to which the angle iron is attached, thereby causing the path of the drive stake to direct it against the angle iron.

While the foregoing invention has been described in connection with a preferred embodiment, the scope of the present invention is defined by the appended claims and variations within such scope are contemplated. For example, the drive post, stake member and crossbar can be fabricated of impact-resistant plastic. Other variations may be similarly envisioned.

What is claimed is:

1. Apparatus for holding a sign a distance above the ground, comprising:

(a) a first hollow member having a ground penetrating end, an upper end, and a length;

(b) a second hollow member, reciprocally removably attached to and parallel to the length of said first member;

(c) means for providing impact form reciprocating movement of said second member on said first member;

(d) means for fixing said second member to said first member at a selectable position along said length of said first member, said second member having an enclosed sleeve attached to the upper end thereof;

(e) a third member, removably, perpendicularly attached to an upper portion of said second member and slidably movable through said enclosed sleeve; and (f) means for securing at least one sign to said third member comprising a tab having a downwardly extending flange for receiving a sign-hanging hook and a pair of upwardly extending flanges for defining a groove into which an upwardly extending sign may be placed, said securing means further defining an aperture portion for receiving said third member therein, said tab having means for fixedly securing said tab to said third member at a predetermined position.

2. The apparatus of 1 wherein said means for providing impact includes an angle iron of L-shaped cross-section fixed to a side of said first member.

* * * * *